US006381922B1

(12) United States Patent
Chang et al.

(10) Patent No.: US 6,381,922 B1
(45) Date of Patent: May 7, 2002

(54) TRANSVERSE DISPLACEMENT MECHANISM FOR COMPACT DISC PACKAGING MACHINE

(76) Inventors: Chen Hsien Chang, 3F, No. 5, Ai Shin I Street, Ta Li City, Taichung Hsien; Chia Wen Liu, 3F, No. 326, Yung Hsing Road, Ta Li City, Taichung Hsien; Mao Lung Chien, No. 6, Dong Guang Yuan Road, East Zone, Taichung, all of (TW)

( * ) Notice: Subject to any disclaimer, the term of this patent is extended or adjusted under 35 U.S.C. 154(b) by 79 days.

(21) Appl. No.: 09/625,257

(22) Filed: Jul. 25, 2000

(51) Int. Cl.[7] ..... B65B 5/04
(52) U.S. Cl. ..... 53/254; 53/251; 53/169
(58) Field of Search ..... 53/169, 251, 252, 53/254

(56) References Cited

U.S. PATENT DOCUMENTS 5,163,271 A * 11/1992 Pan et al. ..... 53/254
5,207,050 A * 5/1993 Fulkerson ..... 53/254
5,285,620 A * 2/1994 Kaye ..... 53/251
5,341,624 A * 8/1994 Kaye ..... 53/251
5,816,028 A * 10/1998 Zaniboni ..... 53/445

* cited by examiner

*Primary Examiner*—John Sipos
(74) *Attorney, Agent, or Firm*—Charles E. Baxley

(57) ABSTRACT

The present invention mainly relates to a transverse displacement mechanism for a compact disc packaging machine includes a working table, an intermittent driving member, a motor, a rocking lever set, and a plurality of transverse displacement frames. The rocking lever set includes two parallel front curved rocking levers, two parallel rear curved rocking levers, two triangular first rotary blocks, two L-shaped second rotary blocks, and two parallel inner curved rocking levers. In operation, the front curved rocking levers, the rear curved rocking levers, and the inner curved rocking levers co-operate with each other to form an eddy state during operation. In such a manner, most of the components of the rocking lever set are hidden in the working table so that the operation of the rocking lever set can be mainly performed in the working table mainly, thereby greatly saving the space of the transverse displacement mechanism for a compact disc packaging machine.

3 Claims, 9 Drawing Sheets

TRANSVERSE DISPLACEMENT MECHANISM FOR COMPACT DISC PACKAGING MACHINE

BACKGROUND OF THE INVENTION

1. Field of the Invention

The present invention primarily relates to a transverse displacement mechanism, and more particularly to a transverse displacement mechanism for a compact disc packaging machine.

2. Description of the Related Art

The closest prior art of which the applicant is aware is disclosed in the U.S. Pat. No. 5,816,028 to Zaniboni, filed on Jun. 13, 1996, entitled by "COMPACT DISC PACKAGING MACHINE".

However, the parallel rocking supports 89, the T-shaped bell cranks 79 and 87, and the links 91 of the driving device of the compact disc packaging machine are all exposed on the working table to co-operate with each other for processing the operation of the compact disc packaging machine so that the driving device occupies a large space of the factory and easily interfere with the view of the operator due to its large volume. In addition, the motor 43 works in conjunction with a transmission 73 so as to transmit the power to a plurality of T-shaped bell cranks 79 and 87 and links 91, and the T-shaped bell cranks 79 and 87 and the links 91 then drive the rocking supports 89 to move. Therefore, the operation of the rocking supports 89 are effected by at least two driving members, thereby greatly decreasing the stability of the operation of the rocking supports 89. Further, the conventional compact disc packaging machine has a complex construction consists of many components, thereby increasing the cost of fabrication.

SUMMARY OF THE INVENTION

The present invention has arisen to mitigate and/or obviate the disadvantage of the conventional compact disc packaging machine.

In accordance with one aspect of the present invention, there is provided a transverse displacement mechanism for a compact disc packaging machine comprising:

a working table;

an intermittent driving member mounted on the working table and having two sides each provided with an upper power output shaft and a lower output shaft, and having one end provided with a power input shaft for rotating the upper power output shaft and the lower output shaft;

a motor mounted on the intermittent driving member for rotating the power input shaft;

a rocking lever set mounted on the working table and symmetrically mounted on the two sides of the intermittent driving member, the rocking lever set including:

two upper rotary arms each secured on the upper power output shaft to rotate therewith;

two lower rotary arms each secured on the lower power output shaft to rotate therewith;

two parallel front curved rocking levers each having a first end pivotally mounted on a front end of each of the two upper rotary arms;

two parallel rear curved rocking levers each having an upper end pivotally mounted on a second end of each of the two front curved rocking levers by a first pivot axle and each having a lower end extending into the working table;

two triangular first rotary blocks each having a central portion pivotally mounted in the working table and each having a first end pivotally mounted on the lower end of each of the two rear curved rocking levers;

two first linking levers each located in the working table and each having a first end pivotally mounted on a second end of each of the two first rotary blocks;

two L-shaped second rotary blocks each having a central portion pivotally mounted in the working table and each having a first end and a mediate portion located between the first end and the central portion and pivotally connected with a second end of each of the two first linking levers;

two second linking levers each located in the working table and each having a first end pivotally mounted on the first end of each of the two second rotary blocks and a second end pivotally mounted on a front end of each of the two lower rotary arms; and two parallel inner curved rocking levers each having an upper end pivotally mounted on a second pivot axle and each having a lower end extending into the working table and pivotally mounted on a second end of each of the two second rotary blocks; and a plurality of transverse displacement frames each having a first end secured on the first pivot axle and a second end secured on the second pivot axle, and each including at least one vacuum sucker;

wherein, the front curved rocking levers, the rear curved rocking levers, and the inner curved rocking levers co-operate with each other to form an eddy state during operation, and wherein, the first pivot axle and the second pivot axle are in parallel with each other.

Further benefits and advantages of the present invention will become apparent after a careful reading of the detailed description with appropriate reference to the accompanying drawings.

DETAILED DESCRIPTION OF THE INVENTION

Figure 1:
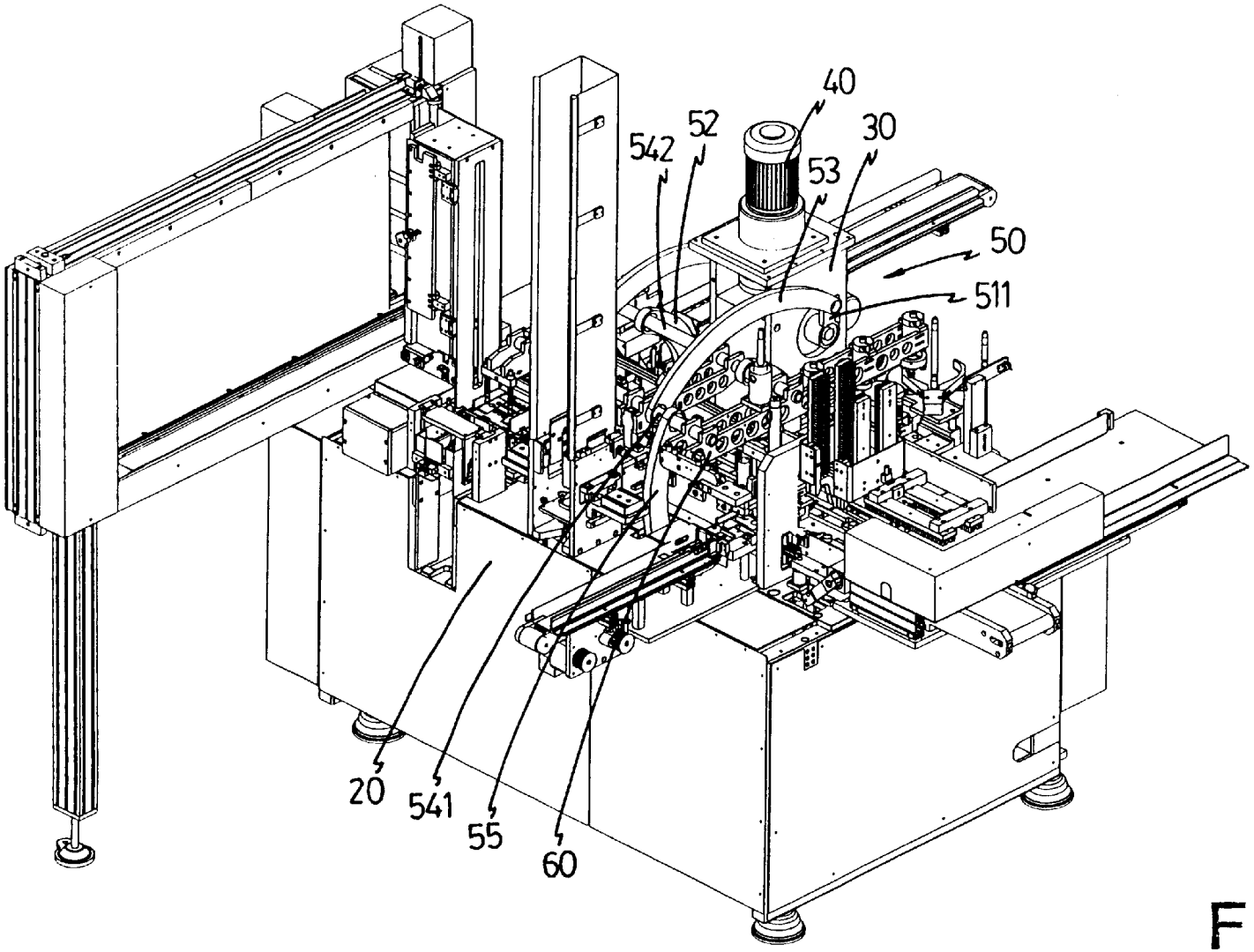
FIG. 1 is a perspective view of a transverse displacement mechanism for a compact disc packaging machine in accordance with the present invention.

Referring to the drawings and initially to FIGS. 1–4, a transverse displacement mechanism for a compact disc packaging machine in accordance with the present invention comprises a working table 20, an intermittent driving member 30, a motor 40, a rocking lever set 50, and a plurality of transverse displacement frames 60.

The working table 20 is provided with a set of automatic feeding equipment.

The intermittent driving member 30 is mounted on the working table 20 and has two sides each provided with an upper power output shaft 31 and a lower output shaft 32, and has a top end provided with a power input shaft 33 for rotating the upper power output shaft 31 and the lower output shaft 32.

The motor 40 is mounted on the intermittent driving member 30 for rotating the power input shaft 33.

The rocking lever set 50 is mounted on the working table 20 and symmetrically mounted on the two sides of the intermittent driving member 30. The rocking lever set 50 includes: two upper rotary arms 511 each secured on the upper power output shaft 31 to rotate therewith; two lower rotary arms 512 each secured on the lower power output shaft 32 to rotate therewith; two parallel front curved rocking levers 53 each having a first end pivotally mounted on a front end of each of the two upper rotary arms 511; two parallel rear curved rocking levers 55 each having an upper end pivotally mounted on a second end of each of the two front curved rocking levers 53 by a first pivot axle 541 and each having a lower end extending into the working table 20; two triangular first rotary blocks 57 each having a central portion pivotally mounted in the working table 20 and each having a first end 570 pivotally mounted on the lower end of each of the two rear curved rocking levers 55; two first linking levers 581 each located in the working table 20 and each having a first end pivotally mounted on a second end 572 of each of the two first rotary blocks 57; two L-shaped second rotary blocks 59 each having a central portion pivotally mounted in the working table 20 and each having a first end 591 and a mediate portion 590 located between the first end 591 and the central portion and pivotally connected with a second end of each of the two first linking levers 581; two second linking levers 582 each located in the working table 20 and each having a first end pivotally mounted on the first end 591 of each of the two second rotary blocks 59 and a second end pivotally mounted on a front end of each of the two lower rotary arms 512; and two parallel inner curved rocking levers 52 each having an upper end pivotally mounted on a second pivot axle 542 and each having a lower end extending into the working table 20 and pivotally mounted on a second end 592 of each of the two second rotary blocks 59.

Each of the transverse displacement frames 60 is provided with a plurality of one vacuum suckers 61, and has a first end secured on the first pivot axle 541 and a second end secured on the second pivot axle 542.

It is appreciated that, the front curved rocking levers 53, the rear curved rocking levers 54, and the inner curved rocking levers 52 co-operate with each other to form an eddy state during operation, and the first pivot axle 541 and the second pivot axle 542 are in parallel with each other.

The first end 570 of each of the two first rotary blocks 57 is pivotally mounted on the lower end of each of the two rear curved rocking levers 55 by a pivot rod 56. The pivot rod 56 is also in parallel with the first pivot axle 541 and the second pivot axle 542.

Figure 2:
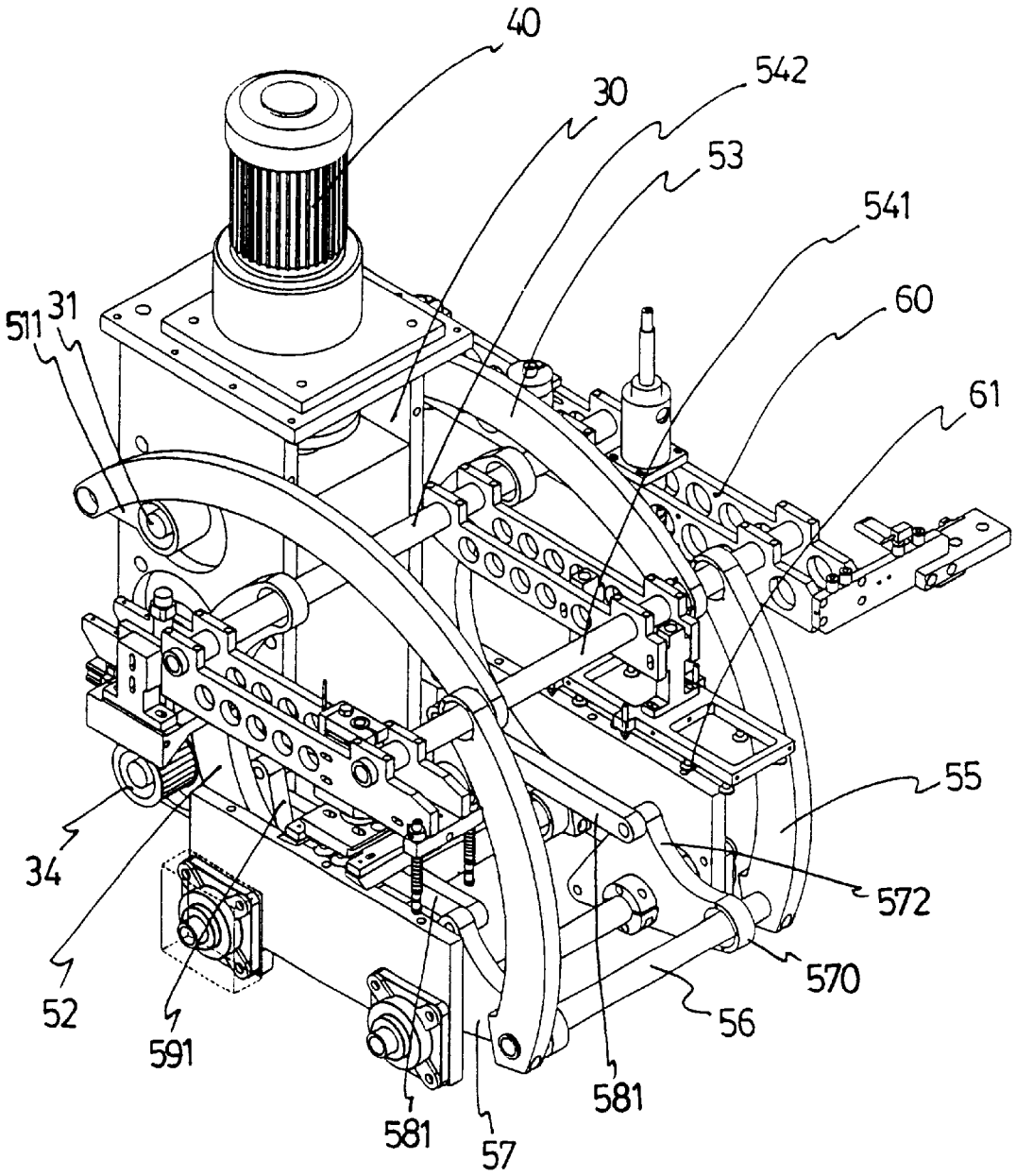
FIG. 2 is an enlarged view of the transverse displacement mechanism as shown in FIG. 1.
Figure 3:
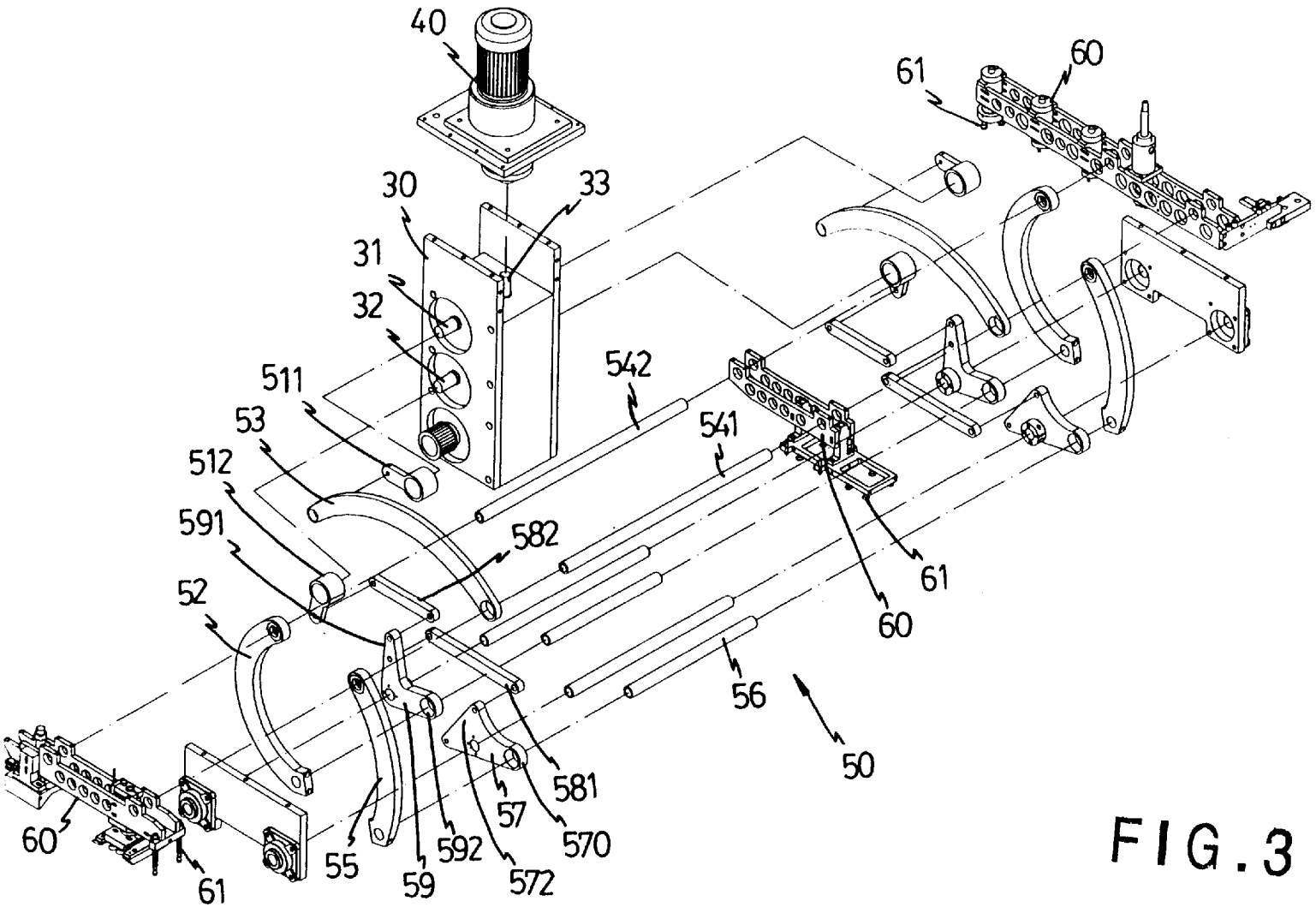
FIG. 3 is an exploded view of the transverse displacement mechanism as shown in FIG. 2.
Figure 4:
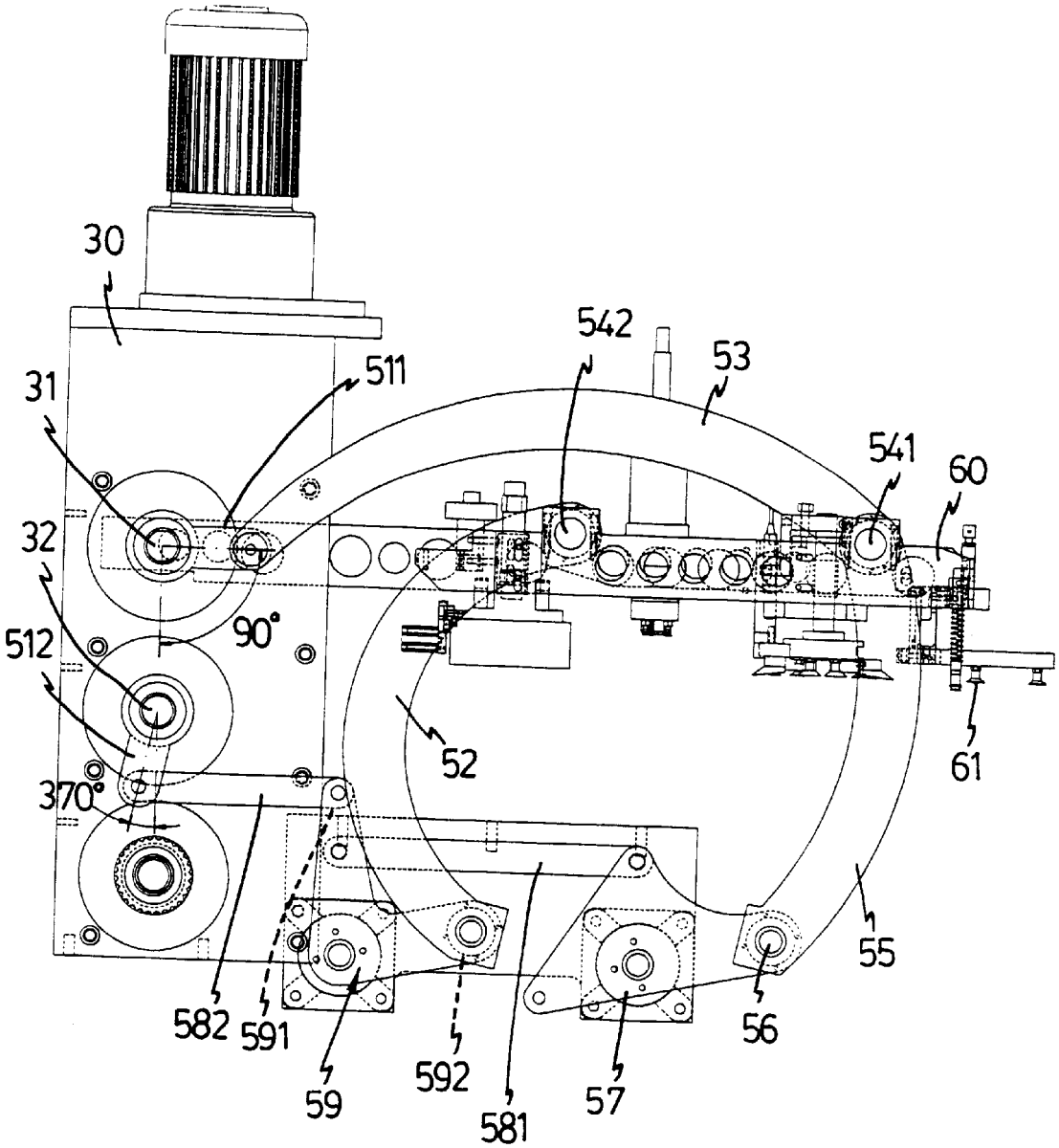
FIG. 4 is a side plan view of the transverse displacement mechanism as shown in FIG. 2.

In operation, referring to FIG. 4 with reference to FIGS. 1–3, before operation of the transverse displacement mechanism of the present invention, the upper rotary arm 511 is retained at the position of 90 degrees while the lower rotary arm 512 is retained at the position of 370 degrees. It is to be noted that, when the upper rotary arm 511 is vertically directed downward, the upper rotary arm 511 is retained at the position of 0 degrees, and when the lower rotary arm 512 is vertically directed downward, the lower rotary arm 512 is retained at the position of 0 degrees.

As shown in FIG. 4, the parallel front curved rocking levers 53 are moved rightward by the upper rotary arms 5 11 to the rightmost position while the pivot axle 541 and the parallel rear curved rocking levers 55 are also moved rightward by front curved rocking levers 53 to the rightmost position. At the same time, the linking levers 582 are moved by the lower rotary arms 512 to retain the first end 591 of each of the L-shaped rotary blocks 59 at a vertical state while the parallel inner curved rocking levers 52 are lifted by the second end 592 of each of the L-shaped rotary blocks 59. At the same time, the linking levers 581 co-operate with the parallel rear curved rocking levers 55 to rotate the triangular rotary blocks 57 to slightly incline leftward whereby the parallel rear curved rocking levers 55 and the pivot axle 541 are also lifted.

In such a manner, when the upper rotary arm 511 is retained at the position of 90 degrees, and the lower rotary arm 512 is retained at the position of 370 degrees, the transverse displacement frames 60 are retained at an upper position of its rightmost state. In such a situation, the vacuum suckers 61 of the transverse displacement frames 60 are not in contact with the parts of the compact disc packaging machine.

Figure 5:
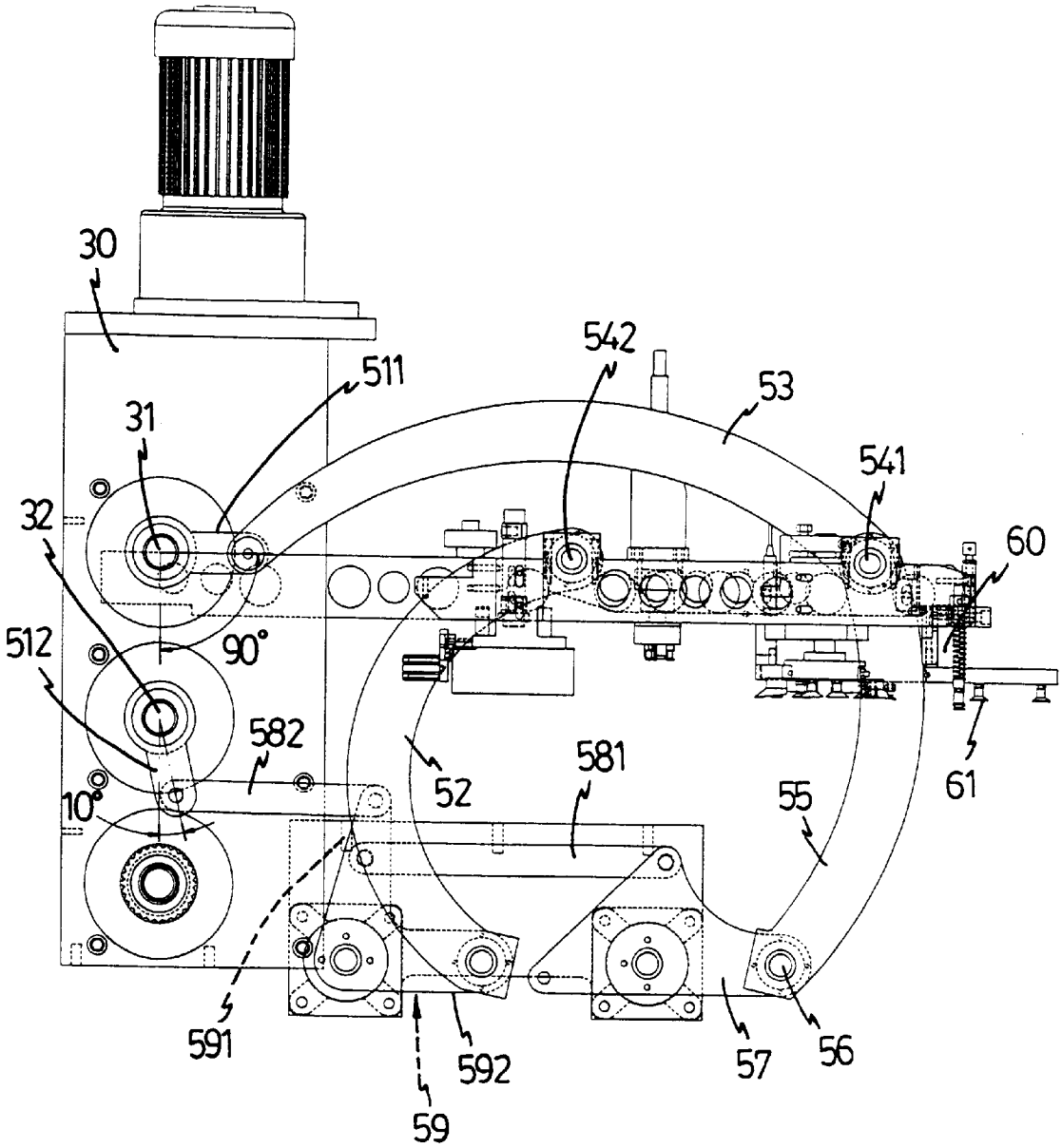
FIG. 5 is an operational view of the transverse displacement mechanism as shown in FIG. 4.

Referring now to FIG. 5 with reference to FIGS. 1–3, the transverse displacement mechanism of the present invention starts operating. The upper rotary arm 511 is still retained at the position of 90 degrees while the lower rotary arm 512 is rotated to the position of 10 degrees. The upper rotary arms 511 are not moved so that the parallel front curved rocking levers 53, the pivot axle 541, and the parallel rear curved rocking levers 55 are retained at the rightmost position. The linking levers 582 are moved rightward by the lower rotary arms 512 to push the first end 591 of each of the L-shaped rotary blocks 59 to incline rightward while the parallel inner curved rocking levers 52 are lowered by the second end 592 of each of the L-shaped rotary blocks 59. At the same time, the linking levers 581 co-operate with the parallel rear curved rocking levers 55 to rotate the triangular rotary blocks 57 which is then disposed at a horizontal state whereby the parallel rear curved rocking levers 55 and the pivot axle 541 are also lowered.

In such a manner, when the upper rotary arm 511 is retained at the position of 90 degrees, and the lower rotary arm 512 is retained at the position of 10 degrees, the transverse displacement frames 60 are retained at a lower position of its rightmost state. In such a situation, the vacuum suckers 61 of the transverse displacement frames 60 are moved downward to suck the parts of the compact disc packaging machine.

Figure 6:
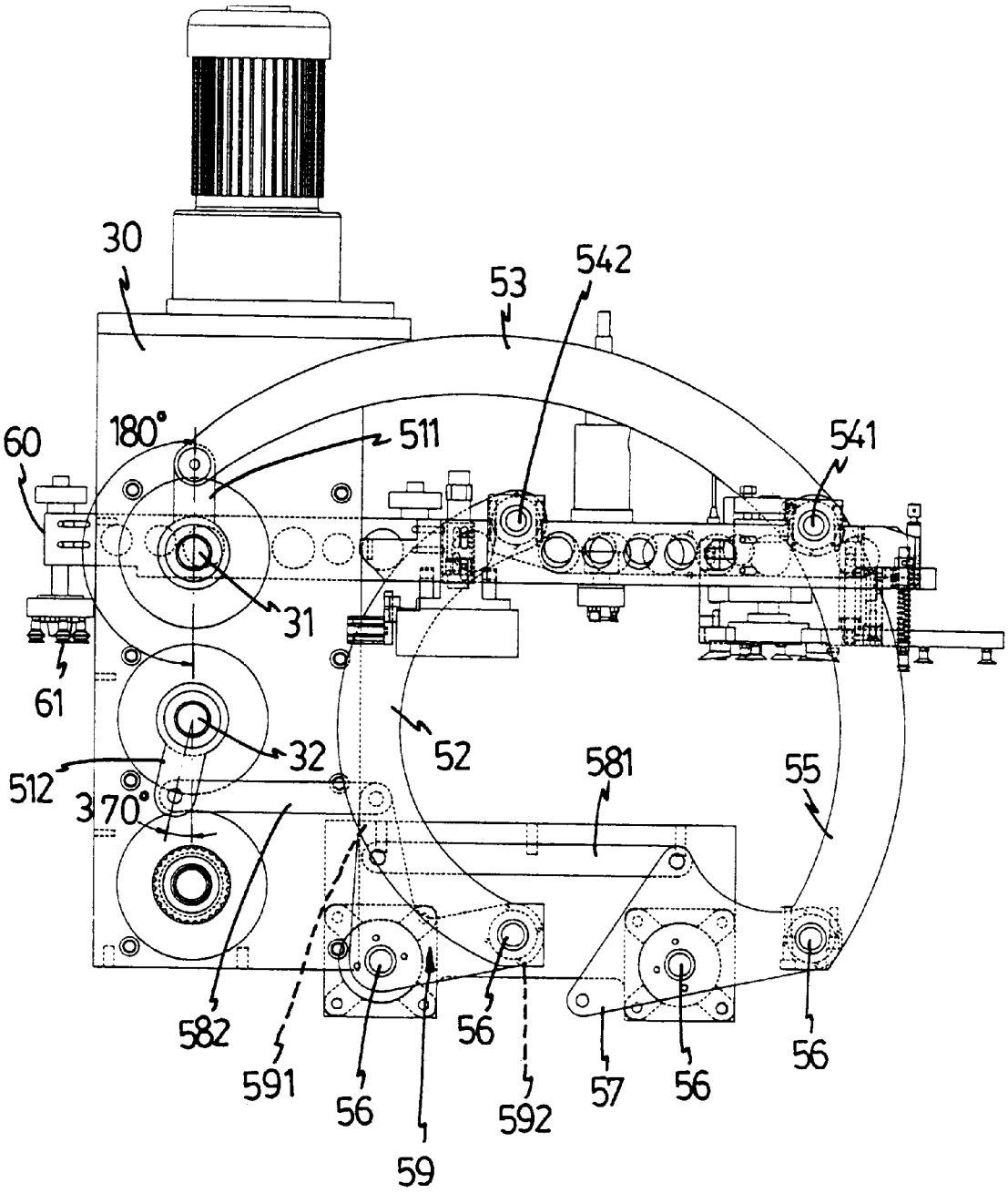
FIG. 6 is an operational view of the transverse displacement mechanism as shown in FIG. 5.

Referring now to FIG. 6 with reference to FIGS. 1–3, the upper rotary arm 511 is rotated to the position of 180 degrees while the lower rotary arm 512 is rotated to the position of 370 degrees. The parallel front curved rocking levers 53 and the pivot axle 541 are moved leftward by the upper rotary arms 511. At the same time, the linking levers 582 are moved leftward by the lower rotary arms 512 to again retain the first end 591 of each of the L-shaped rotary blocks 59 at a vertical state while the parallel inner curved rocking levers 52 are lifted by the second end 592 of each of the L-shaped rotary blocks 59. At the same time, the linking levers 581 co-operate with the parallel rear curved rocking levers 55 to rotate the triangular rotary blocks 57 to slightly incline leftward whereby the parallel rear curved rocking levers 55 and the pivot axle 541 are also lifted.

In such a manner, when the upper rotary arm 511 is retained at the position of 180 degrees, and the lower rotary arm 512 is retained at the position of 370 degrees, the transverse displacement frames 60 are moved from right to left and are retained at an upper position. In such a situation, the vacuum suckers 61 of the transverse displacement frames 60 will carry the parts of the compact disc packaging machine from right to left.

Figure 7:
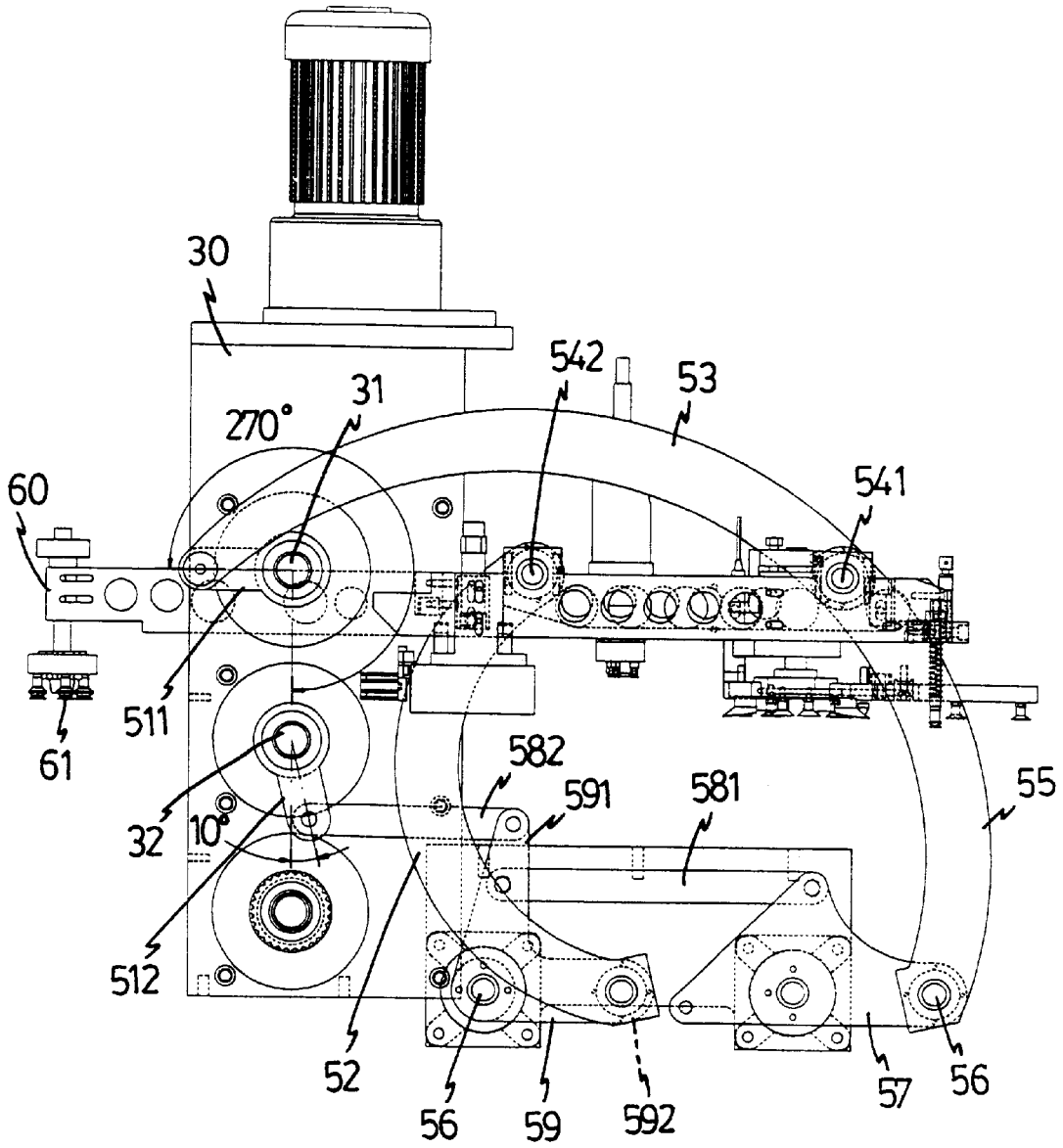
FIG. 7 is an operational view of the transverse displacement mechanism as shown in FIG. 6.

Referring now to FIG. 7 with reference to FIGS. 1–3, the upper rotary arm 511 is rotated to the position of 270 degrees while the lower rotary arm 512 is rotated to the position of 10 degrees. The parallel front curved rocking levers 53 and the pivot axle 541 are then moved by the upper rotary arms 511 to the leftmost position. The linking levers 582 are moved rightward by the lower rotary arms 512 to push the first end 591 of each of the L-shaped rotary blocks 59 to incline rightward while the parallel inner curved rocking levers 52 are lowered by the second end 592 of each of the L-shaped rotary blocks 59. At the same time, the linking levers 581 co-operate with the parallel rear curved rocking levers 55 to rotate the triangular rotary blocks 57 which is then disposed at a horizontal state whereby the parallel rear curved rocking levers 55 and the pivot axle 541 are also lowered.

In such a manner, when the upper rotary arm 511 is retained at the position of 270 degrees, and the lower rotary arm 512 is retained at the position of 10 degrees, the transverse displacement frames 60 are retained at a lower position of its leftmost state. In such a situation, the vacuum suckers 61 of the transverse displacement frames 60 are moved downward to release the parts of the compact disc packaging machine.

Figure 8:
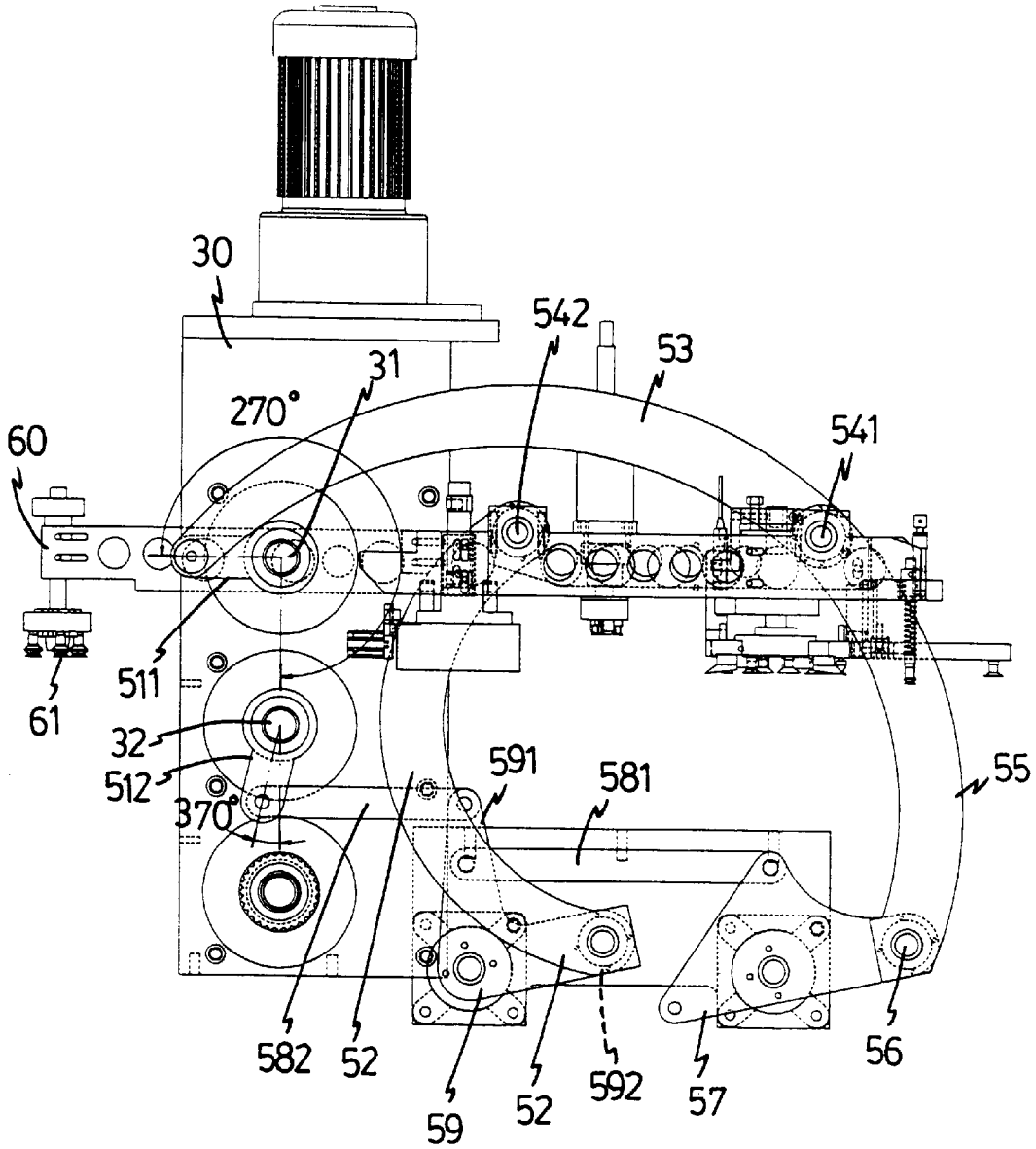
FIG. 8 is an operational view of the transverse displacement mechanism as shown in FIG. 7.

Referring now to FIG. 8 with reference to FIGS. 1–3, the upper rotary arm 511 is retained the position of 270 degrees while the lower rotary arm 512 is rotated to the position of 370 degrees. The parallel front curved rocking levers 53 and the pivot axle 541 are retained at the leftmost position. At the same time, the linking levers 582 are moved leftward by the lower rotary arms 512 to again retain the first end 591 of each of the L-shaped rotary blocks 59 at a vertical state while the parallel inner curved rocking levers 52 are lifted by the second end 592 of each of the L-shaped rotary blocks 59. At the same time, the linking levers 581 co-operate with the parallel rear curved rocking levers 55 to rotate the triangular rotary blocks 57 to slightly incline leftward whereby the parallel rear curved rocking levers 55 and the pivot axle 541 are also lifted.

In such a manner, when the upper rotary arm 511 is retained at the position of 270 degrees, and the lower rotary arm 512 is retained at the position of 370 degrees, the transverse displacement frames 60 are retained at an upper position of the leftmost state. In such a situation, the vacuum suckers 61 of the transverse displacement frames 60 are lifted after the parts of the compact disc packaging machine are released.

Figure 9:
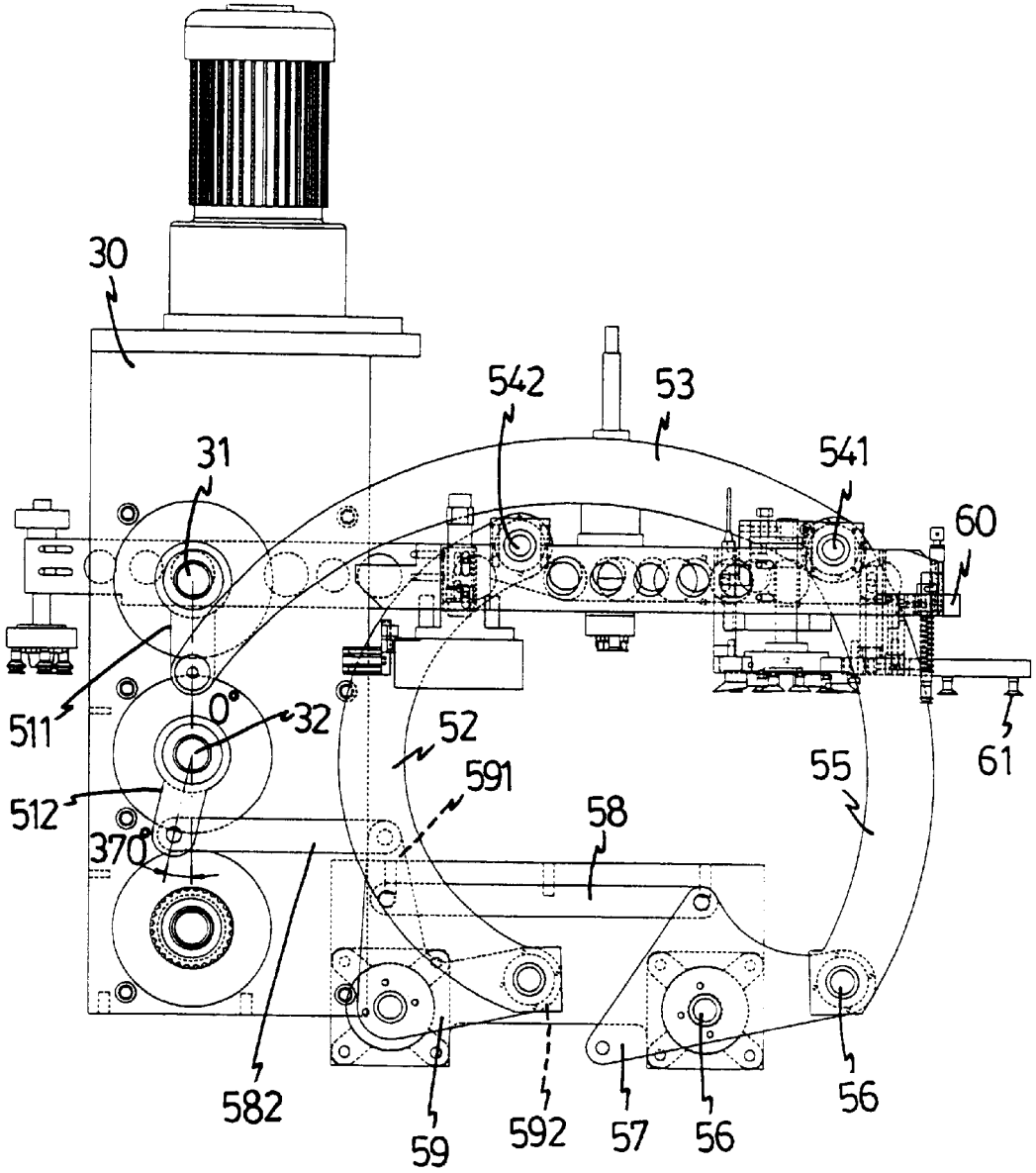
FIG. 9 is an operational view of the transverse displacement mechanism as shown in FIG. 8.

Referring now to FIG. 9 with reference to FIGS. 1–3, the upper rotary arm 511 is rotated to the position of 0 degrees while the lower rotary arm 512 is retained at the position of 370 degrees. The parallel front curved rocking levers 53 and the pivot axle 541 are moved rightward. At the same time, the linking levers 582 are used to retain the first end 591 of each of the L-shaped rotary blocks 59 at a vertical state while the parallel inner curved rocking levers 52 are lifted by the second end 592 of each of the L-shaped rotary blocks 59. At the same time, the linking levers 581 co-operate with the parallel rear curved rocking levers 55 to rotate the triangular rotary blocks 57 to slightly incline leftward whereby the parallel rear curved rocking levers 55 and the pivot axle 541 are also lifted.

In such a manner, when the upper rotary arm 511 is retained at the position of 0 degrees, and the lower rotary arm 512 is retained at the position of 370 degrees, the transverse displacement frames 60 are moved from left to right, and is retained at an upper position. In such a situation, the vacuum suckers 61 of the transverse displacement frames 60 are moved from left to right.

Finally, returning now to FIG. 4, the upper rotary arm 511 is retained at the position of 90 degrees while the lower rotary arm 512 is retained at the position of 370 degrees. In such a manner, the transverse displacement frames 60 are retained at an upper position of its rightmost state. In such a situation, the vacuum suckers 61 of the transverse displacement frames 60 are not in contact with the parts of the compact disc packaging machine.

Accordingly, according to the transverse displacement mechanism of the present invention, the front curved rocking levers 53, the rear curved rocking levers 54, and the inner curved rocking levers 52 of the rocking lever set 30 co-operate with each other to form an eddy state during operation so that most of the components of the rocking lever set 50 are hidden in the working table 20 as shown in FIG. 1 whereby the operation of the rocking lever set 50 is mainly performed in the working table 20, so as to save the space of the transverse displacement mechanism for a compact disc packaging machine, thereby reducing the volume on the working surface of the working table 20, and thereby increasing the space of the factory without interfering with the view of the operator.

In addition, the power is supplied by the motor 40 in conjunction with the intermittent driving member 30 without having to provide multiple sets of actuating devices co-operating with each other as are disclosed in the prior art of U.S. Pat. No. 5,816,028 so as to directly reduce the members, thereby simplifying the structure of the transverse displacement mechanism of the present invention, and saving the cost of fabrication. Further, the operation of the rocking lever set 50 of the present invention is stable by the motor 40 in conjunction with the intermittent driving member 30.

It should be clear to those skilled in the art that further embodiments may be made without departing from the scope of the present invention.

What is claimed is:

1. A transverse displacement mechanism for a compact disc packaging machine comprising:

a working table (20);

an intermittent driving member (30) mounted on said working table (20) and having two sides each provided with an upper power output shaft (31) and a lower output shaft (32), and having one end provided with a power input shaft (33) for rotating said upper power output shaft (31) and said lower output shaft (32);

a motor (40) mounted on said intermittent driving member (30) for rotating said power input shaft (33);

a rocking lever set (50) mounted on said working table (20) and symmetrically mounted on said two sides of said intermittent driving member (30), said rocking lever set (50) including:

two upper rotary arms (511) each secured on said upper power output shaft (31) to rotate therewith;

two lower rotary arms (512) each secured on said lower power output shaft (32) to rotate therewith;

two parallel front curved rocking levers (53) each having a first end pivotally mounted on a front end of each of said two upper rotary arms (511);

two parallel rear curved rocking levers (55) each having an upper end pivotally mounted on a second end of each of said two front curved rocking levers (53) by a first pivot axle (541) and each having a lower end extending into said working table (20);

two triangular first rotary blocks (57) each having a central portion pivotally mounted in said working table (20) and each having a first end (570) pivotally mounted on said lower end of each of said two rear curved rocking levers (55);

two first linking levers (581) each located in said working table (20) and each having a first end pivotally mounted on a second end (572) of each of said two first rotary blocks (57);

two L-shaped second rotary blocks (59) each having a central portion pivotally mounted in said working table (20) and each having a first end (591) and a mediate portion (590) located between said first end (591) and said central portion and pivotally connected with a second end of each of said two first linking levers (581);

two second linking levers (582) each located in said working table (20) and each having a first end pivotally mounted on said first end (591) of each of said two second rotary blocks (59) and a second end pivotally mounted on a front end of each of said two lower rotary arms (512); and two parallel inner curved rocking levers (52) each having an upper end pivotally mounted on a second pivot axle (542) and each having a lower end extending into said working table (20) and pivotally mounted on a second end (592) of each of said two second rotary blocks (59); and a plurality of transverse displacement frames (60) each having a first end secured on said first pivot axle (541) and a second end secured on said second pivot axle (542), and each including at least one vacuum sucker (61);

wherein, said front curved rocking levers (53), said rear curved rocking levers (54), and said inner curved rocking levers (52) co-operate with each other to form an eddy state during operation, and wherein, said first pivot axle (541) and said second pivot axle (542) are in parallel with each other.

2. The transverse displacement mechanism in accordance with claim 1, wherein said first end (570) of each of said two first rotary blocks (57) is pivotally mounted on said lower end of each of said two rear curved rocking levers (55) by a pivot rod (56).

3. The transverse displacement mechanism in accordance with claim 2, wherein said pivot rod (56) is in parallel with said first pivot axle (541) and said second pivot axle (542).

* * * * *